US005255816A

United States Patent [19]

Trepp

[11] Patent Number: 5,255,816

[45] Date of Patent: Oct. 26, 1993

[54] ARTICLE STORING APPARATUS

[76] Inventor: Charles A. Trepp, 3885 Transport St., Ventura, Calif. 93003

[21] Appl. No.: 994,304

[22] Filed: Dec. 21, 1992

[51] Int. Cl.[5] ..... B65D 25/06

[52] U.S. Cl. ..... 220/529; 206/338; 206/503; 220/4.27; 220/761

[58] Field of Search ..... 206/338, 503, 508, 509, 206/821, 499; 220/4.27, 507, 510, 532, 533, 757, 761, 528, 529

[56] References Cited

U.S. PATENT DOCUMENTS

| | | | |
|---|---|---|---|
| 422,184 | 2/1890 | Copleston | 220/532 |
| 1,292,935 | 1/1919 | Walsh | 220/533 |
| 2,608,241 | 8/1952 | Doern | 220/532 |
| 2,826,332 | 3/1958 | Hudson | 220/761 |
| 2,903,127 | 9/1959 | Dorman | 206/338 |
| 3,734,337 | 5/1973 | Garrison | 220/533 |
| 4,119,231 | 10/1978 | Johnson | 206/499 |
| 4,593,818 | 6/1986 | Schenkman | 206/503 |
| 5,054,668 | 10/1991 | Ricchiuti | 220/533 |

*Primary Examiner*—Jimmy G. Foster
*Attorney, Agent, or Firm*—Jack C. Munro

[57] ABSTRACT

An article storing apparatus which utilizes a container like housing which has an internal chamber which is divided into a plurality of different article storing compartments by means of planar panels which are mounted within the internal chamber. Centrally mounted within the internal chamber is a center post with these panels engaging with that center post. Centrally dividing the internal chamber into two equal sections is a main dividing wall with this center post being located at the midpoint of the main dividing wall. A handle is mounted in conjunction with the main dividing wall and is movable between the retracted position and the extended position. These article storing apparatuses can be located in a stacked relationship on a separate stacking ring or can be placed within a separate container.

2 Claims, 1 Drawing Sheet

ARTICLE STORING APPARATUS

BACKGROUND OF THE INVENTION

1. FIELD OF THE INVENTION

The field of this invention relates to apparatuses that conveniently store an accumulation of small items.

2. DESCRIPTION OF PRIOR ART

In many environments, a mass of different small parts are accumulated. For example, within machine shops, auto repair shops and other similar types of businesses there are utilized different sizes of nuts, bolts, screws and other similar types of fasteners. It is common for these articles to be stored in a single container such as an empty coffee can, paint bucket or other similar type of container. The different sizes or different types of articles are not divided and separated from one another. Therefore, when an individual wishes to obtain a particular size or particular type of part, it is necessary for that individual to rummage through the entire accumulation of parts and hoping to find the particular desired part.

Common types of containers that are utilized for this purpose are coffee cans and five gallon paint buckets. The use of such containers for this purpose is common since once the coffee can and the paint bucket have been utilized for their originally intended purpose, such can be utilized for this secondary purpose. However, there is a need to construct a device that facilitates the storage of small articles that permit the small articles to be segregated into different sizes or types and also possibly this device to be usable in conjunction with the coffee can or the paint bucket or other similar type of container.

SUMMARY OF THE INVENTION

The structure of the present invention constitutes an open top cyclindrical type of housing that has an internal recess. This internal recess is divided by a main dividing wall into two substantially equal sized sections. Associated with each section are a plurality of removable planar panels with these panels to be used to divide each section into a plurality of separate article storage compartments. The main dividing wall has a handle mounted in conjunction therewith with the handle to be movable from a retracted position to an extended position and when in the retracted position the handle is out of the way not hindering usage of the article storing apparatus. When the handle is moved to the extended position, such is in a position to facilitate manual carrying of the apparatus from one locale to another. These article storage apparatuses are constructed to facilitate stacking either by themselves or in conjunction with a separate stacking ring and are capable of being stacked in conjunction with a separate container such as a coffee can or paint bucket.

The primary objective of the present invention is to construct a cylindrical type of tray or container that has an open top which can be utilized to store a variety of different types of sizes of small parts in a segregated arrangement.

Another objective of the present invention is to construct an article storing apparatus which when utilized in conjunction with conventionally available separate containers, such as paint buckets and coffee cans, permits a plurality of the article storing apparatuses to be mounted therein in a stacked arrangement.

Another objective of the present invention is to construct an article storing apparatus which can be manufactured inexpensively and therefore sold to the ultimate consumer at an inexpensive price.

Another objective of the present invention is to construct an article storing apparatus which can be readily carried from one locale to another by means of a retractable handle arrangement.

DETAILED DESCRIPTION OF THE SHOWN EMBODIMENT

Figure 1:
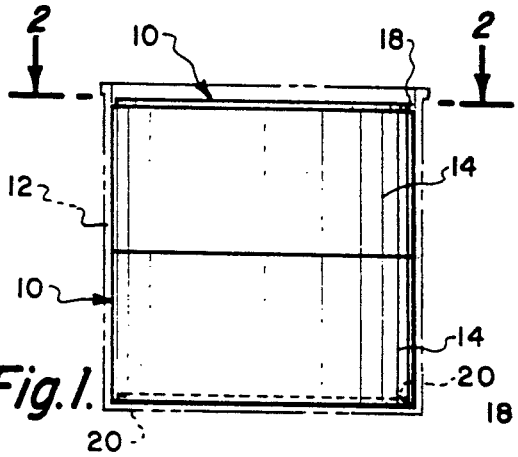
FIG. 1 is a side elevational view of a pair of the articles storing apparatuses of this invention depicting locating of the apparatuses in conjunction with an exterior container such as a paint bucket or a coffee can.

Referring particularly to the drawing, there is shown in FIG. 1 a pair of the article storing apparatuses 10 of this invention located in a stacked relationship with the apparatuses 10 located in a close-fitting relationship within a container 12. The container 12 can be of any convenient size with a typical such container comprising a three pound coffee can or a five gallon paint bucket. In the case of a five gallon paint bucket, it is to be understood that the article storing apparatus 10 will be of a larger size than what would be used in conjunction with the coffee can. The advantage of locating the apparatuses 10 within the container 12 is that in essence a storage chest type of arrangement is attained that is not only inexpensive but utilizes containers that are normally discarded after their initial usage. Within places of business it is exceedingly common to utilize empty paint buckets and empty coffee cans to store small articles such as nuts, bolts, screws and the like. The advantage of using the apparatuses 10 of this invention is that the same container is utilized as a storage chest but where the articles stored are divided according to some desirable division arrangement such as type of article and/or size of article. It is to be noted that the small articles that are to be stored by the apparatus 10 of this invention is not shown within the drawing.

Figure 3:
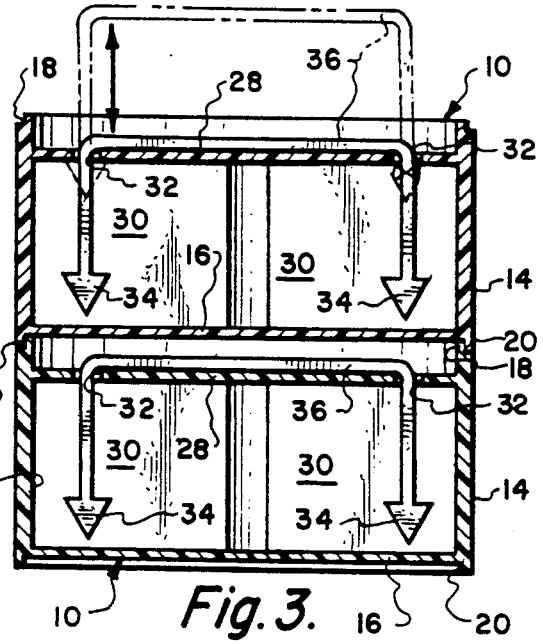
FIG. 3 is a cross-sectional view through a pair of the stacked article storing apparatuses of the present invention taken along line 3—3 of FIG. 2 showing more clearly the operation of the handle in conjunction with the article storing apparatuses.
Figure 4:
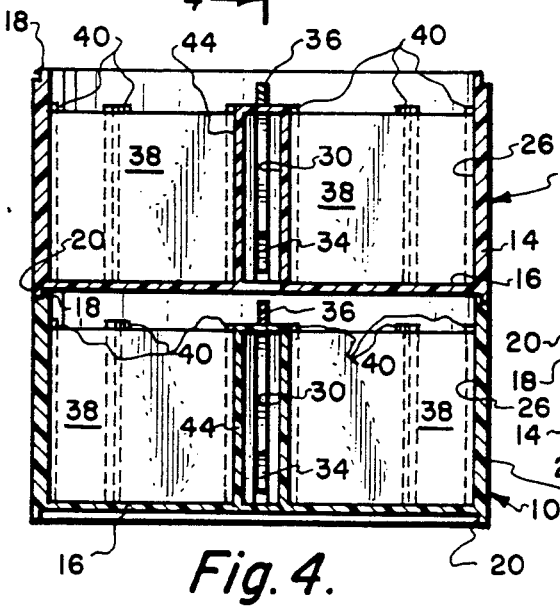
FIG. 4 is a cross-sectional view taken along line 4—4 of FIG. 2 which is taken at a ninety degree position relative to the cross-sectional view of FIG. 3.
Figure 6:
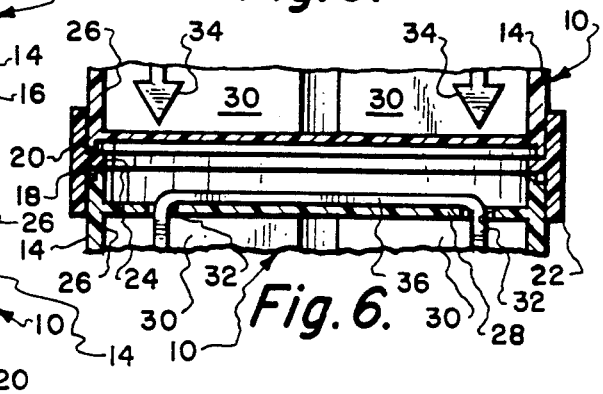
FIG. 6 is a cross-sectional view through one of the stacking rings of FIG. 5 taken along line 6—6 of FIG. 5.

The article storing apparatus 10 of this invention utilizes a cylindrically shaped housing 14 which has a closed bottom 16 and an open top. The sidewall of the housing 14 adjacent the open top includes an annular groove 18. The peripheral edge of the bottom wall 16 includes an annular protuberance 20. The annular protuberance 20 of one storage apparatus 10 is to be engagable with an annular groove 18 of another storage apparatus 10. This arrangement of groove 18 and protuberance 20 is a locking arrangement which permits one apparatus 10 to be stacked on top of another apparatus 10 and establish a fixed relationship therebetween. This type of locking arrangement is utilized whether the apparatuses 10 are located within a separate container 12 or merely stacked one on top of the other as is shown in FIGS. 3 and 4. In order to obtain a more secure locking arrangement between a pair of apparatuses 10 there may be utilized a separate stacking ring 22. This stacking ring 22 is open interiorly but its interior wall does include an annular inwardly extending ridge 24. When utilizing of the ring 22, the lower surface of the ridge 24 is to rest against the upper edge of the sidewall 14 of one apparatus 10 with the annular protuberance 20 of another apparatus 10 resting against the upper edge of the ridge 24. This arrangement is clearly depicted within FIG. 6.

Each apparatus 10 includes an internal compartment 26. Fixedly mounted diametrically across the internal compartment 26, dividing the internal compartment 26 into a pair of equally sized sections is a main dividing wall 28. This main dividing wall 28 is open interiorly forming a hollow chamber 30.

Within the upper surface of the wall 28 is formed a pair of holes 32. These holes 32 are of equal size and each hole 32 is spaced about the same distance from the sidewall of the internal chamber 26. A pointed end 34 of a U-shaped handle member 36 is to be connectable with each hole 32 with it being understood that there is a separate pointed end 34 for each hole 32. Actually, the pointed end 34 must be forcibly inserted through the hole 32 which laterally compresses the pointed end as depicted in dotted lines in FIG. 3. When the pointed ends 34 are fully inserted into hollow chamber 30, retraction of the handle member 36 from the wall 28 is not possible. The handle member 36 can be located in a retracted position with the apex section of the handle member 36 located directly against the dividing wall 28. In this particular position the pointed ends 34 are located very near the bottom 16. The handle member 36 can also be moved to an upward or extended position which is shown in phantom lines in FIG. 3 which will connect the back edge of the pointed ends 34 to the inside surface of the main dividing wall 28 which will then permit the apparatus 10 to be readily carried from one locale to another. It is to be understood that once the handle member 36 is released it will automatically fall to the retracted position. Movement of the handle member 36 to the extended position is to be accomplished manually.

Each section of the compartment 26 can be divided into compartments by the use of a plurality of planar panels 38. Mounted within each section of the internal chamber 26 on the sidewall of the internal chamber are a plurality of engaging devices 40 each of which forms a vertical open-ended groove. The panel engagements are fixedly mounted to the sidewall of internal chamber 26 in an evenly spaced apart manner. Similar panel engagements 42 are fixedly mounted to the exterior wall of a center post 44. The center post 44 is integrally formed on the dividing wall 28 with the dividing wall 28 passing essentially through the center of the center post 44. Center post 44 is also located at the midpoint of the longitudinal length of wall 28. There are three in number of the engagement sections 42 mounted on the center post 44 within each section of the internal chamber 26 making a total of six in number of engagement sections mounted on the center post 44. In a similar manner, there are three in number of the engagement sections 40 mounted on the interior surface of the sidewall 14 within each section of the internal chamber 26.

Figure 2:
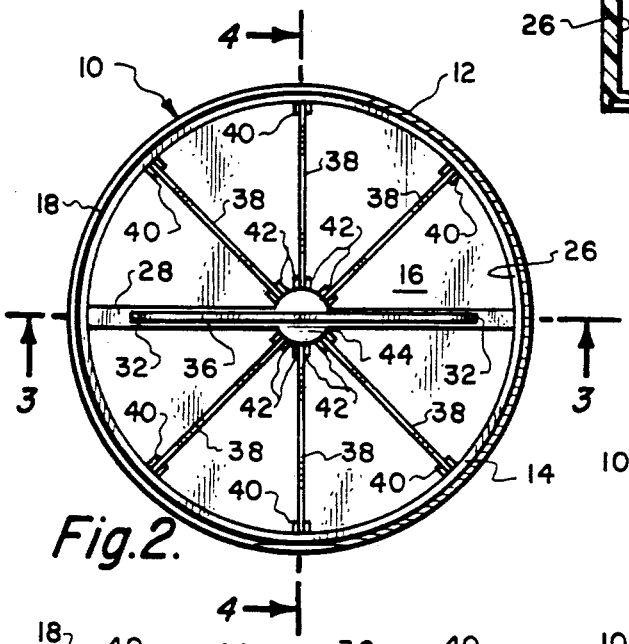
FIG. 2 is a top plan view of the article storing apparatus of the present invention taken along line 2—2 of FIG. 1.
Figure 5:
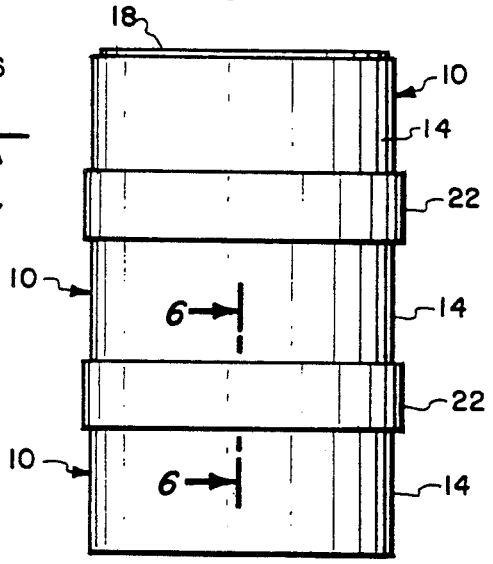
FIG. 5 is a side elevational view showing three in number of the article storing apparatuses of this invention located in a stacked arrangement utilizing a separate stacking ring.

If a panel 38 is placed in conjunction with an aligned pair of an engagement device 40 and an engagement device 42, the internal chamber 26 will be divided into eight equal sized compartments as is clearly shown within FIG. 2 of the drawing. It is to be understood that one or more of the panels 38 may be removed so as to make a particular compartment larger.

What is claimed is:

1. An article storing apparatus comprising:

a housing having an internal chamber, said internal chamber having an enclosing sidewall;

a main dividing wall mounted within said internal chamber, said main dividing wall dividing said internal chamber into two substantially equal sections;

a center post attached to said main dividing wall, said center post being mounted at the longitudinal midpoint of said main dividing wall;

a first dividing panel engaging means mounted on said center post, a second dividing panel engaging means mounted on said sidewall, a plurality of panels being removably mounted in a spaced apart arrangement between said first and said second dividing panel engaging means forming a plurality of separate article storage compartments within said internal chamber; and a handle connected to said main dividing wall, said handle being movable between a retracted position and an extended position relative to said main dividing wall, said handle being rigid and being in the same shape when in said retracted position and in said extended position, with said handle in said extended position said handle to be used to facilitate manual carrying of said article storing apparatus.

2. The article storing apparatus as defined in claim 1 wherein:

said main dividing wall having a hollow interior chamber, said handle to be mounted in conjunction with said hollow interior chamber, when said handle is in said retracted position a significant portion of said handle is located within said hollow interior chamber, said handle being U-shaped terminating in a pair of spaced apart pointed ends, said main dividing wall having a pair of spaced apart holes, said pointed ends being of the same size, said holes being of the same size, each said pointed end being larger than each said hole, a said pointed end to be forcibly inserted through a said hole to obtain initial connection of said handle with said main dividing wall, once said connection is established separation is prevented of said handle from said main dividing wall.

* * * * *